US011798500B2

(12) United States Patent
Park et al.

(10) Patent No.: US 11,798,500 B2
(45) Date of Patent: Oct. 24, 2023

(54) DISPLAY DEVICE

(71) Applicant: LG Display Co., Ltd., Seoul (KR)

(72) Inventors: Jeonghyo Park, Gunpo-si (KR); Minho Cho, Paju-si (KR)

(73) Assignee: LG Display Co., Ltd., Seoul (KR)

( * ) Notice: Subject to any disclaimer, the term of this patent is extended or adjusted under 35 U.S.C. 154(b) by 0 days.

(21) Appl. No.: 18/084,271

(22) Filed: Dec. 19, 2022

(65) Prior Publication Data

US 2023/0206865 A1 Jun. 29, 2023

(30) Foreign Application Priority Data

Dec. 24, 2021 (KR) ..... 10-2021-0187193
Dec. 13, 2022 (KR) ..... 10-2022-0173773

(51) Int. Cl.
*G09G 3/3291* (2016.01)

(52) U.S. Cl.
CPC ... *G09G 3/3291* (2013.01); *G09G 2300/0819* (2013.01); *G09G 2300/0842* (2013.01); *G09G 2310/08* (2013.01); *G09G 2320/0693* (2013.01); *G09G 2360/16* (2013.01); *G09G 2360/18* (2013.01)

(58) Field of Classification Search
CPC ..... G09G 3/3291; G09G 2300/0819; G09G 2300/0842; G09G 2310/08; G09G 2320/0693; G09G 2360/16; G09G 2360/18
See application file for complete search history.

(56) References Cited

U.S. PATENT DOCUMENTS 8,120,566 B2 * 2/2012 Kim ..... G09G 3/2096 345/98
2019/0066603 A1 * 2/2019 Lee ..... G09G 3/3233
2023/0047875 A1 * 2/2023 An ..... G09G 3/3258
2023/0129090 A1 * 4/2023 Kim ..... G09G 3/3233 345/690

FOREIGN PATENT DOCUMENTS

KR 10-2016-0056058 A 5/2016
KR 10-2017-0135378 A 12/2017

* cited by examiner

*Primary Examiner* — Chanh D Nguyen
*Assistant Examiner* — Ngan T. Pham-Lu
(74) *Attorney, Agent, or Firm* — Morgan, Lewis & Bockius LLP

(57) ABSTRACT

A display device may include: a display panel configured to be driven in an active time and a blank time within one frame and including pixels each having a driving transistor; a data driver configured to provide a first data voltage based on an image data to the pixels in the active time; and a timing controller configured to compensate for the image data based on a first compensation data for a threshold voltage of the driving transistor and a second compensation data for a mobility of the driving transistor, the timing controller including a data compensator, a non-volatile memory, and volatile memories. The timing controller may be further configured to read a reference first compensation data from the non-volatile memory in the active time and update the first compensation data and the second compensation data to be stored in one of the volatile memories in the blank time.

20 Claims, 10 Drawing Sheets

DISPLAY DEVICE

CROSS-REFERENCE TO RELATED APPLICATIONS

This application claims the priority of Korean Patent Application No. 10-2021-0187193 filed on Dec. 24, 2021, and No. 10-2022-0173773 filed on Dec. 13, 2022, in the Korean Intellectual Property Office, the disclosure of each of which is incorporated herein by reference.

BACKGROUND

1. Technical Field

The present disclosure relates to a display device and, more particularly, to a display device capable of compensating for data more accurately.

2. Description of the Related Art

Among display devices used for a monitor of a computer, a television, a cellular phone, or other electronic devices are an organic light emitting display device (OLED), which is a self-emitting device, and a liquid crystal display device (LCD), which requires a separate light source.

Among various display devices, an organic light emitting display device includes a display panel including a plurality of sub pixels and a driver which drives the display panel. The driver may include a gate driver for supplying a gate signal to the display panel and a data driver for supplying a data voltage. When a signal, such as a gate signal and a data voltage, is supplied to a sub pixel of the organic light emitting display device, the selected sub pixel emits light to display images.

In recent years, to improve the image quality, a mobility and a threshold voltage of the driving transistor disposed in the sub pixel are sensed to compensate for the data based thereon.

Data for compensation may be damaged due to external factors, such as electrostatic discharge (ESD) and physical impacts, so that normal compensation driving may not be performed.

SUMMARY

Accordingly, embodiments of the present disclosure are directed to a display device that substantially obviates one or more problems due to the limitations and disadvantages of the related art.

An object of the present disclosure includes providing a display device capable of normally performing the compensation driving even if external factors occur.

Another object of the present disclosure includes providing a display device capable of removing potentially erroneous compensation data in real time.

The features and aspects of the present disclosure are not limited to those mentioned above. Additional features and aspects will be set forth in part in the description that follows and in part will become apparent to those skilled in the art from the description or may be learned by practice of the inventive concepts provided herein. Other features and aspects of the inventive concepts may be realized and attained by the structure particularly pointed out in, or derivable from, the written description, the claims hereof, and the appended drawings.

To achieve these and other advantages and in accordance with the purpose of the disclosure, as embodied and broadly described herein, a display device may include: a display panel configured to be driven in an active time and a blank time within one frame, the display panel including a plurality of pixels each having a driving transistor; a data driver configured to provide a first data voltage based on an image data to the plurality of pixels in the active time; and a timing controller configured to compensate for the image data based on a first compensation data for a threshold voltage of the driving transistor and on a second compensation data for a mobility of the driving transistor, the timing controller including a data compensator, a non-volatile memory, and a plurality of volatile memories. The timing controller may be further configured to: read a reference first compensation data from the non-volatile memory in the active time, the reference first compensation data being a reference value for the first compensation data; and update the first compensation data and the second compensation data to be stored in one of the plurality of volatile memories in the blank time.

In another aspect of the present disclosure, a method of driving a display device including a display panel, configured to be driven in an active time and a blank time within one frame and including a plurality of pixels each having a driving transistor, a non-volatile memory, a buffer memory, and a plurality of volatile memories, may include: reading a reference first compensation data from the non-volatile memory in the active time, the reference first compensation data being a reference value of a first compensation data for a threshold voltage of the driving transistor; writing the reference first compensation data in the buffer memory in the active time; reading the reference first compensation data from the buffer memory in the blank time following the active time; calculating a sensing data for a mobility of the driving transistor in the blank time; updating the first compensation data based on the reference first compensation data in the blank time and updating a second compensation data for the mobility of the driving transistor based on the sensing data in the blank time; and storing the updated first compensation data and the updated second compensation data in one of the plurality of volatile memories in the blank time.

In yet another aspect of the present disclosure, A display device may include: a display panel configured to be driven in an active time and a blank time within one frame, the display panel including a plurality of pixels each having a driving transistor; a data driver configured to provide a first data voltage based on an image data to the plurality of pixels in the active time for displaying an image, and provide a second data voltage for sensing a mobility of the driving transistor to the plurality of pixels in the blank time for determining a sensing data; a plurality of volatile memories to store a first compensation data for a threshold voltage of the driving transistor and a second compensation data for the mobility of the driving transistor; a non-volatile memory to store a reference first compensation data, the reference first compensation data being a reference value for the first compensation data; and a data compensator configured to update the first compensation data based on the reference first compensation data in the blank time, and update the second compensation data based on the sensing data in the blank time.

According to example embodiments of the present disclosure, a characteristic value of a driving transistor may be normally compensated despite one or more external factors.

According to example embodiments of the present disclosure, time delay for compensation of image data may be minimized.

It is to be understood that both the foregoing general description and the following detailed description of the present disclosure are by way of example and explanatory and are intended to provide further explanation of the inventive concepts as claimed.

BRIEF DESCRIPTION OF THE DRAWINGS

The accompanying drawings, which are included to provide a further understanding of the disclosure and are incorporated in and constitute a part of this application, illustrate embodiments of the disclosure and together with the description serve to explain principles of the disclosure. In the drawings.

DETAILED DESCRIPTION

Reference will now be made in detail to embodiments of the present disclosure, examples of which may be illustrated in the accompanying drawings.

A transistor used for a display device according to embodiments of the present disclosure may be implemented with an n-channel transistor (NMOS) or a p-channel transistor (PMOS). The transistor may be implemented with an oxide semiconductor transistor having an oxide semiconductor as an active layer or an LTPS transistor having a low temperature poly-silicon (LTPS) as an active layer. The transistor may include at least a gate electrode, a source electrode, and a drain electrode. The transistor may be implemented as a thin film transistor on a display panel. In the transistor, carriers may flow from the source electrode to the drain electrode. In the case of the n-channel transistor (NMOS), since the carriers are electrons, to allow the electrons to flow from the source electrode to the drain electrode, a source voltage may be lower than a drain voltage. A direction of the current in the n-channel transistor NMOS may be from the drain electrode to the source electrode, and the source electrode may serve as an output terminal. In the case of the p-channel transistor (PMOS), since the carriers are holes, to allow the holes to flow from the source electrode to the drain electrode, a source voltage may be higher than a drain voltage. In the p-channel transistor PMOS, the holes may flow from the source electrode to the drain electrode so that current flows from the source to the drain and the drain electrode serves as an output terminal. Accordingly, the source and the drain may be switched in accordance with the applied voltage so that it should be noted that the source and the drain of the transistor are not fixed. In the following description, the transistor is assumed to be a n-channel transistor (NMOS), but present disclosure is not limited thereto. The p-channel transistor may be used, and thus a circuit configuration may be changed accordingly.

A gate signal of transistors used as switching elements may swing between a turn-on voltage and a turn-off voltage. The turn-on voltage may be set to be higher than a threshold voltage Vth of the transistor, and the turn-off voltage may be set to be lower than the threshold voltage Vth of the transistor. The transistor may be turned on in response to the turn-on voltage and be turned off in response to the turn-off voltage. In the case of the NMOS, the turn-on voltage may be a high voltage, and the turn-off voltage may be a low voltage. In the case of the PMOS, the turn-on voltage may be a low voltage, and the turn-off voltage may be a high voltage.

Figure 1:
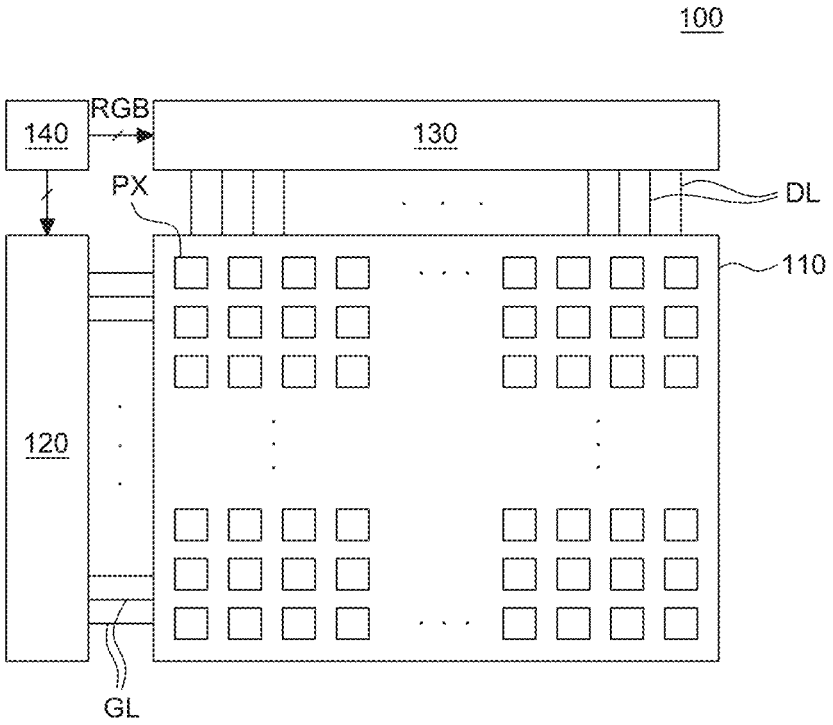
FIG. 1 is a schematic view of a display device according to an example embodiment of the present disclosure.

FIG. 1 is a schematic view of a display device according to an example embodiment of the present disclosure.

As illustrated in FIG. 1, a display device 100 may include a display panel 110, a gate driver 120, a data driver 130, and a timing controller 140.

The display panel 110 may be a panel for displaying images. The display panel 110 may include various circuits, wiring lines, and light emitting diodes disposed on a substrate. The display panel 110 may be divided by a plurality of data lines DL and a plurality of gate lines GL intersecting each other and may include a plurality of pixels PX connected to the plurality of data lines DL and the plurality of gate lines GL, respectively. The display panel 110 may include a display area defined by a plurality of pixels PX and a non-display area in which various signal lines or pads may be formed. The display panel 110 may be implemented by a display panel 110 used in various display devices, such as a liquid crystal display device, an organic light emitting display device, or an electrophoretic display device. In example embodiments described below, the display panel 110 is described as a panel used in the organic light emitting display device, but the present disclosure is not limited thereto.

The timing controller 140 may receive timing signals, such as a vertical synchronization signal, a horizontal synchronization signal, a data enable signal, or a dot clock, by means of a receiving circuit, such as an LVDS or TMDS interface, connected to a host system. The timing controller 140 may generate a data control signal to control the data driver 130 and gate control signals to control the gate driver 120, based on the input timing signals.

The timing controller 140 may process image data RGB input from an external source suitable for a size and a resolution of the display panel 110 to supply the processed image data to the data driver 130.

The timing controller 140 may sense a characteristic value (e.g., a mobility or a threshold voltage) of a driving transistor disposed in each of the plurality of pixels PX to generate compensation data for the characteristic value (e.g., a mobility or a threshold voltage) of the driving transistor. The timing controller 140 may compensate for image data RGB using the compensation data.

The data driver 130 may supply a data voltage Vdata to the plurality of sub pixels. The data driver 130 may include a source printed circuit board and a plurality of source integrated circuits. Each of the plurality of source driving integrated circuits may be supplied with image data RGB and a data control signal from the timing controller 140 by means of a source printed circuit board.

The data driver 130 may convert image data RGB into a gamma voltage in response to the data control signal to generate a data voltage Vdata and may supply the data voltage Vdata through the data lines DL of the display panel 110.

The data driver 130 may receive the sensing voltage from the plurality of pixels PX to convert the sensing voltage into sensing data for a characteristic value (e.g., a mobility or a threshold voltage) of the driving transistor. The sensing data may be output to the timing controller 140.

The plurality of source integrated circuits may be connected to the data lines DL of the display panel 100 in the form of chip on film. To be more specific, each of the plurality of source integrated circuits may be implemented as a chip disposed on a connection film, and wiring lines connected to the source integrated circuit chip or chips may also be formed on the connection film. However, the placement of the plurality of source integrated circuits is not limited thereto and may be connected to the data lines DL of the display panel 110 by, for example, a chip on glass (COG) process or a tape automated bonding (TAB) process.

The gate driver 120 may supply a gate signal to the plurality of sub pixels. The gate driver 120 may include a level shifter and a shift register. The level shifter may shift a level of a clock signal input at a transistor-transistor-logic (TTL) level from the timing controller 140 and then may supply the clock signal to the shift register. The shift register may be formed in the non-display area of the display panel 110, by a GIP manner, but is not limited thereto. The shift register may have a plurality of stages which shifts the gate signal to output, in response to the clock signal and the driving signal. The plurality of stages included in the shift register may sequentially output the gate signal through a plurality of output terminals.

The display panel 110 may include a plurality of sub pixels. The plurality of sub pixels may emit light of different colors. For example, the plurality of sub pixels may include a red sub pixel, a green sub pixel, a blue sub pixel, and a white sub pixel, but is not limited thereto. The plurality of sub pixels may configure a pixel PX. That is, the red sub pixel, the green sub pixel, the blue sub pixel, and the white sub pixel may configure one pixel PX, and the display panel 110 may include a plurality of pixels PX. For ease of reference, a sub pixel is referred to as a pixel or pixel PX in the below description.

Hereinafter, an example driving circuit for driving one pixel (or one sub pixel) will be described in more detail with reference to FIG. 2.

Figure 2:
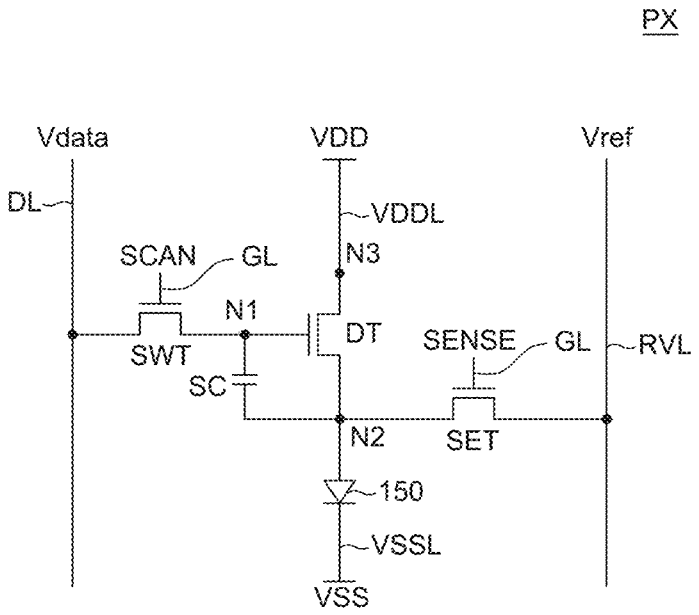
FIG. 2 is a circuit diagram of a sub pixel of a display device according to an example embodiment of the present disclosure.

FIG. 2 is a circuit diagram of a pixel of a display device according to an example embodiment of the present disclosure.

FIG. 2 illustrates a circuit diagram for one pixel among a plurality of pixels of the display device 100.

As shown in FIG. 2, the pixel may include a switching transistor SWT, a sensing transistor SET, a driving transistor DT, a storage capacitor SC, and a light emitting diode 150.

The light emitting diode 150 may include an anode, an organic layer, and a cathode. The organic layer may include various organic layers, such as a hole injection layer, a hole transport layer, an organic light emitting layer, an electron transport layer, and an electron injection layer. The anode of the light emitting diode 150 may be connected to an output terminal of the driving transistor DT, and a low potential voltage VSS may be applied to the cathode through the low potential voltage line VSSL. Even though the light emitting diode 150 in FIG. 2 is described here as an organic light emitting diode 150, the present disclosure is not limited thereto. For example, an inorganic light emitting diode, that is, an LED may also be used as the light emitting diode 150.

The above-described low potential voltage line VSSL may be a positive voltage line which applies a positive low potential voltage and may be denoted as a ground terminal.

As shown in FIG. 2, the switching transistor SWT may be a transistor which transmits the data voltage Vdata to a first node N1 corresponding to a gate electrode of the driving transistor DT. The switching transistor SWT may include a drain electrode connected to the data line DL, a gate electrode connected to the gate line GL, and a source electrode connected to the gate electrode of the driving transistor DT. The switching transistor SWT may be turned on by a scan signal SCAN applied from the gate line GL to transmit a data voltage Vdata supplied from the data line DL to the first node N1 corresponding to the gate electrode of the driving transistor DT.

As illustrated in FIG. 2, the driving transistor DT may be a transistor which supplies a driving current to the light emitting diode 150 to drive the light emitting diode 150. The driving transistor DT may include a gate electrode corresponding to the first node N1, a source electrode corresponding to a second node N2 and an output terminal, and a drain electrode corresponding to a third node N3 and an input terminal. The gate electrode of the driving transistor DT may be connected to the switching transistor SWT, the drain electrode may receive a high potential voltage VDD by means of a high potential voltage line VDDL, and the source electrode may be connected to the anode of the light emitting diode 150.

As shown in FIG. 2, the storage capacitor SC may be a capacitor which maintains a voltage corresponding to the data voltage Vdata for one frame. One electrode of the storage capacitor SC may be connected to the first node N1, and the other electrode may be connected to the second node N2.

In the case of the example display device 100, as the driving time of each pixel is increased, the circuit element such as the driving transistor DT may be degraded. Accordingly, a unique characteristic value of the circuit element, such as a driving transistor DT, may be changed. Here, the unique characteristic value of the circuit element may include a threshold voltage Vth of the driving transistor DT or a mobility a of the driving transistor DT. The change in the characteristic value of the circuit element may cause a luminance change of the corresponding pixel. Accordingly, the change in the characteristic value of the circuit element may be used as representing the luminance change of the pixel.

Further, the degree of change in the characteristic values between circuit elements of each pixel may vary depending on a degree of degradation of each circuit element. Such a difference in the degree of change in the characteristic values between the circuit elements may cause a luminance deviation between the pixels. Accordingly, the characteristic value deviation between circuit elements may be used as representing the luminance deviation between the pixels. The change in the characteristic values of the circuit elements, that is, the luminance change of the pixel, and the characteristic value deviation between the circuit elements, that is, the luminance deviation between the pixels, may cause problems, such as lowering of the accuracy for luminance expressiveness of the pixel or screen abnormality.

Therefore, the pixel of the display device 100 according to the example embodiment of the present disclosure may provide a sensing function of sensing a characteristic value for the pixel and a compensating function of compensating for the characteristic value of the pixel using the sensing result.

Therefore, as illustrated in FIG. 2, the pixel may further include a sensing transistor SET to effectively control a voltage state of the source electrode of the driving transistor DT, in addition to the switching transistor SWT, the driving transistor DT, the storage capacitor SC, and the light emitting diode 150.

As illustrated in FIG. 2, the sensing transistor SET may be connected between the source electrode of the driving transistor DT and the reference voltage line RVL supplying a reference voltage Vref, and a gate electrode may be connected to the gate line GL. Therefore, the sensing transistor SET may be turned on by the sensing signal SENSE applied through the gate line GL to apply the reference voltage Vref supplied through the reference voltage line RVL to the source electrode of the driving transistor DT. Further, the sensing transistor SET may be utilized as one of voltage sensing paths for the source electrode of the driving transistor DT.

As shown in FIG. 2, the switching transistor SWT and the sensing transistor SET of the pixel may share one gate line GL. That is, the switching transistor SWT and the sensing transistor SET may be connected to the same gate line GL to be applied with the same gate signal. However, for the convenience of description, a voltage applied to the gate electrode of the switching transistor SWT may be referred to as a scan signal SCAN, and a voltage applied to the gate electrode of the sensing transistor SET may be referred to as a sensing signal SENSE. However, the scan signal SCAN and the sensing signal SENSE applied to one pixel may be the same signal which is transmitted from the same gate line GL.

However, the present disclosure is not limited thereto. For example, only the switching transistor SWT may be connected to the gate line GL, and the sensing transistor SET may be connected to a separate sensing line. Therefore, the scan signal SCAN may be applied to the switching transistor SWT through the gate line GL, and the sensing signal SENSE may be applied to the sensing transistor SET through a separate sensing line.

Accordingly, the reference voltage Vref may be applied to the source electrode of the driving transistor DT by means of the sensing transistor SET. Further, a sensing voltage for sensing the threshold voltage Vth of the driving transistor DT or the mobility a of the driving transistor DT may be detected through the reference voltage line RVL. Further, the data driver 130 may compensate for the data voltage Vdata in accordance with a variation of the threshold voltage Vth of the driving transistor DT or the mobility a of the driving transistor DT.

Figure 3:
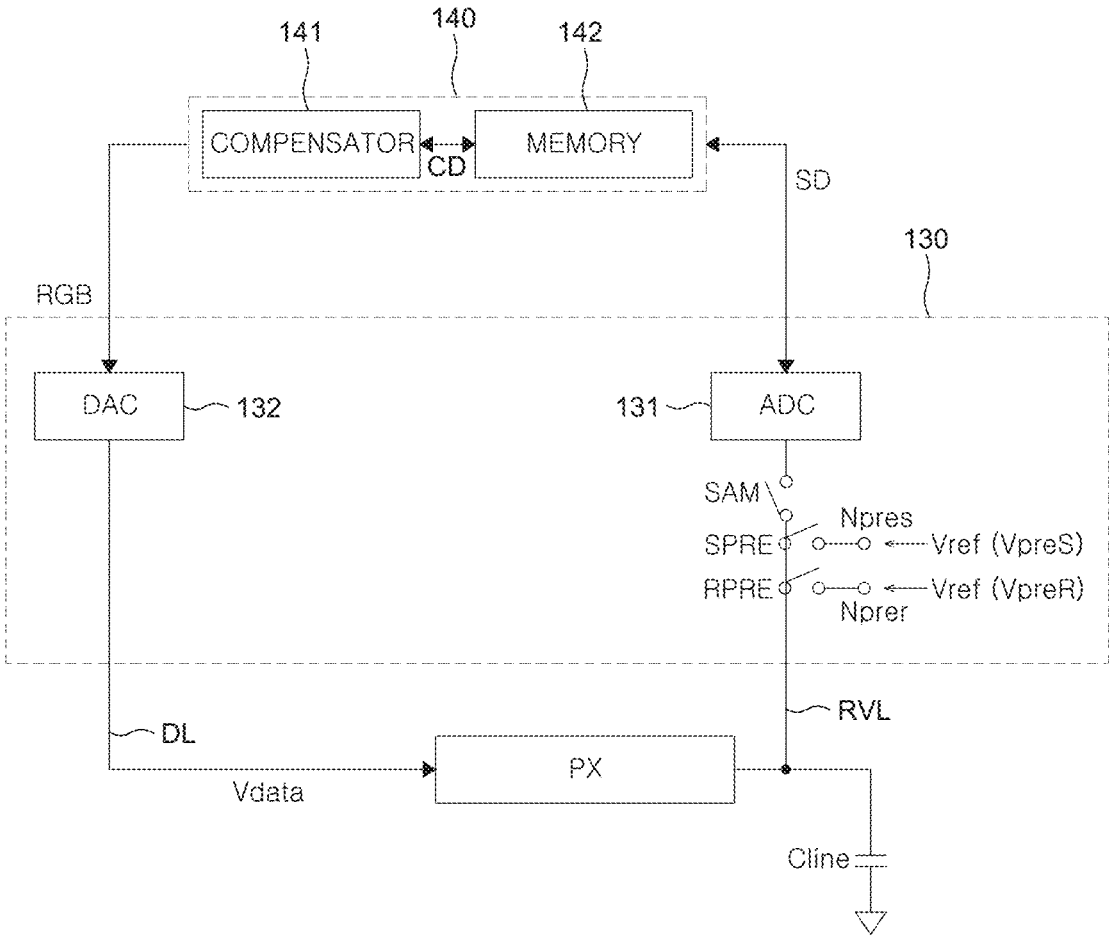
FIG. 3 is a block diagram illustrating a timing controller and a data driver for compensation of a display device according to an example embodiment of the present disclosure.

FIG. 3 is a block diagram illustrating a timing controller and a data driver for compensation of a display device according to an example embodiment of the present disclosure.

As described above, the display device 100 according to an example embodiment of the present disclosure may determine a characteristic value or a change in the characteristic value of a driving transistor DT in the pixel PX from the sensing voltage of the reference voltage line RVL during the sensing period. Therefore, the reference voltage line RVL may not only serve to transmit the reference voltage Vref but may also serve as a sensing line for sensing a characteristic value of the driving transistor DT in the pixel PX. Accordingly, the reference voltage line RVL may also be referred to as a sensing line.

Specifically, as illustrated in FIGS. 2 and 3, during the sensing period of the display device 100 according to an example embodiment of the present disclosure, the characteristic value or the change in the characteristic value of the driving transistor DT may be reflected as a voltage (for example, Vdata−Vth) at the second node N2, e.g., the source electrode of the driving transistor DT.

When the sensing transistor SET is turned on, the voltage at the second node N2 (e.g., the source electrode of the driving transistor DT) may correspond to a sensing voltage on the reference voltage line RVL. Further, the line capacitor Cline on the reference voltage line RVL may be charged by the voltage at the second node N2 of the driving transistor DT, and the reference voltage line RVL may have a sensing voltage corresponding to a voltage at the second node N2 of the driving transistor DT by the charged line capacitor Cline.

The display device 100 according to an example embodiment of the present disclosure may control the switching transistor SWT and the sensing transistor SET in the pixel PX to be turned on/off and may control the supplying of the data voltage Vdata and the reference voltage Vref, respectively. Therefore, the second node N2 of the driving transistor DT may be driven to be in a voltage state reflecting the characteristic value (a threshold voltage or a mobility) or a change in the characteristic value of the driving transistor DT.

The data driver 130 of the display device 100 according to an example embodiment of the present disclosure may include an analog-to-digital converter ADC 131 and switch circuits SAM and SPRE. The analog-to-digital converter ADC 131 may measure a sensing voltage on the reference voltage line RVL corresponding to a voltage of the second node N2 of the driving transistor DT and may convert the sensing voltage into a digital value. The switch circuits SAM and SPRE may sense the characteristic values.

The data driver 130 may include a digital-to-analog converter DAC 132 for converting the image data RGB into an analog gamma voltage to output a data voltage Vdata and a switch RPRE for image driving. In addition, the data driver 130 may further include a latch circuit and buffer circuits for processing image data RGB.

The data driver may further include an ADC 131 and various switches SAM, SPRE, and RPRE. Alternatively, the ADC 131 and various switches SAM, SPRE, RPRE may be provided external to the data driver 130.

The switch circuits SAM and SPRE to control the sensing driving may include a sensing reference switch SPRE and a sampling switch SAM. The sensing reference switch SPRE may control a connection between each reference voltage line RVL and a sensing reference voltage supply node Npres, to which the reference voltage Vref may be supplied. The sampling switch SAM may control the connection between each reference voltage line RVL and the ADC 131.

Here, the sensing reference switch SPRE is a switch which may control the sensing driving. The reference voltage Vref supplied to the reference voltage line RVL by the sensing reference switch SPRE may be a sensing reference voltage VpreS.

The image driving reference switch RPRE may control a connection between each reference voltage line RVL and an image driving reference voltage supplying node Nprer, to which the reference voltage Vref may be supplied. The image driving reference switch RPRE may be a switch used for image driving. The reference voltage Vref supplied to the reference voltage line RVL by the image driving reference switch RPRE may correspond to an image driving reference voltage VpreR.

Here, the sensing reference switch SPRE and the image driving reference switch RPRE may be separately provided or may be implemented to be integrated as one. The sensing reference voltage VpreS and the image driving reference voltage VpreR may be the same voltage value or different voltage values.

The timing controller 140 may include a data compensator 141 to compensate for data and a memory 140 to store data for a long time or a short time.

The memory 142 may store sensing data SD output from the ADC 131 or may store compensation data CD output from the data compensator 141.

The data compensator 141 may calculate new compensation data CD for compensating for a variation in the characteristic value by comparing the sensing data SD and the compensation data CD stored in the memory 142. The new compensation data CD calculated by the data compensator 141 may then be stored in the memory 142.

Specifically, the compensation data CD may be divided into compensation data for a threshold voltage of the driving transistor DT and compensation data for a mobility of the driving transistor DT. Hereinafter, for the convenience of description, the compensation data for the threshold voltage of the driving transistor DT may be referred to as a first compensation data, and the compensation data for the mobility of the driving transistor DT may be referred to as a second compensation data.

Also, the compensation data CD may be a digital data format. For example, the first compensation data (i.e., the threshold voltage compensation data) may be written in some bits of the compensation data CD, and the second compensation data (i.e., the mobility compensation data) may be written in the other bits of the compensation data CD.

The timing controller 140 may compensate for a digital signal type of image data RGB to be supplied to the data driver 130 using compensation data CD stored in the memory 142.

The compensated image data RGB may be output to the data driver 130. Accordingly, the DAC 132 in the data driver 130 may convert image data RGB compensated by the data compensator 141 into an analog signal type of data voltage Vdata to compensate for the data voltage Vdata. After the sensing process for all lines are completed, the compensated data voltage Vdata may be output to the corresponding data lines DL through an output buffer. As a result, the characteristic value deviation (e.g., a threshold voltage deviation or a mobility deviation) for the driving transistor DT in the corresponding pixel PX may be compensated for.

Further, the data compensator 141 may be disposed external to the timing controller 140 or may be included in the timing controller 140. The memory 142 may be disposed external to the timing controller 140 or may be implemented as a register in the timing controller 140.

Figure 4:
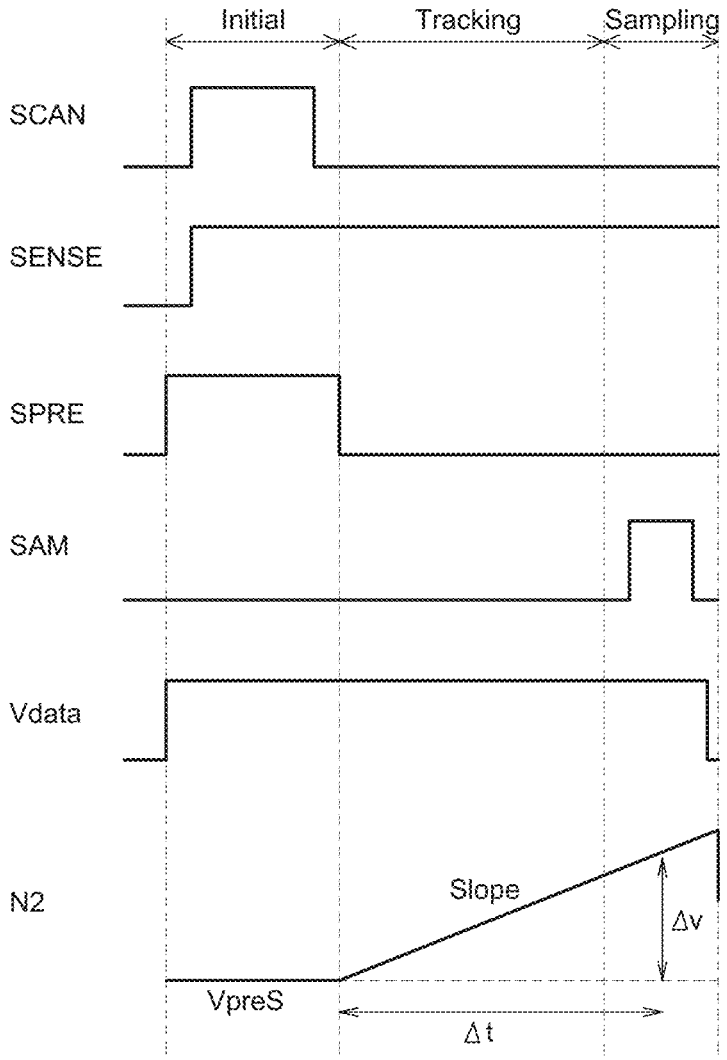
FIG. 4 is a timing chart of a signal for sensing a mobility of a display device according to an example embodiment of the present disclosure.

FIG. 4 is a timing chart of a signal for sensing a mobility of a display device according to an example embodiment of the present disclosure.

As shown in FIG. 4, the mobility sensing of the driving transistor DT in the display device according to an example embodiment of the present disclosure may be performed by an initialization step, a tracking step, and a sampling step. Generally, the mobility of the driving transistor DT may be sensed by individually turning on or turning off the switching transistor SWT and the sensing transistor SET. Therefore, unlike the example structure illustrated in FIG. 2, the sensing operation may be performed with an example structure in which the scan signal SCAN and the sensing signal SENSE may be separately applied to the switching transistor SWT and the sensing transistor SET, respectively, by means of two separate gate lines GL.

In the initialization step (Initial), the switching transistor SWT may be turned on, and the first node N1 (i.e., the gate electrode) of the driving transistor DT may be initialized to a data voltage Vdata for mobility sensing, by the scan signal SCAN at a turn-on level. Hereinafter, an image driving data voltage generated based on the image data RGB may be referred to as a first data voltage, and a sensing data voltage for mobility sensing may be referred to as a second data voltage.

Further, the sensing transistor SET and the sensing reference switch SPRE may be turned on, by a sensing signal SENSE at a turn-on level. In this state, the second node N2 (e.g., the source electrode) of the driving transistor DT may be initialized to the sensing reference voltage VpreS.

Here, the above-described second data voltage for mobility sensing may be different from the first data voltage for displaying the image. Therefore, after finishing the sensing processing during the blank period, the second data voltage may be recovered to a third data voltage.

The above-described third data voltage may be referred to as an image recovering data voltage. The third data voltage may be the same as the first data voltage but is not limited thereto. For example, the third data voltage may be a voltage obtained by adjusting the first data voltage based on a compensation voltage.

The tracking step (Tracking) may be a step of tracking a mobility of the driving transistor DT. The mobility of the driving transistor DT may represent a current driving capability of the driving transistor DT. A voltage at the second node N2 of the driving transistor DT representing a mobility of the driving transistor DT may be tracked by the tracking step.

In the tracking step, the switching transistor SWT may be turned off, and the sensing reference switch SPRE may be shifted to a turn-off level, by a scan signal SCAN at a turn-off level. By doing this, both the first node N1 and the second node N2 of the driving transistor DT may be floated so that the voltages at both the first node N1 and the second node N2 of the driving transistor DT may rise. Specifically, the voltage at the second node N2 of the driving transistor DT may be initialized to a sensing reference voltage VpreS to rise from the sensing reference voltage VpreS. At this time, the sensing transistor SET may be turned on so that the rise in the voltage at the second node N2 of the driving transistor DT may lead to a rise in the sensing voltage on the reference voltage line RVL.

In the sampling step (Sampling), the sampling switch SAM may be turned on when a predetermined time Δt elapses from the time when the voltage at the second node N2 of the driving transistor DT starts to rise. At this time, the ADC 131 may sense the sensing voltage on the reference voltage line RVL connected by the sampling switch SAM and may convert the sensing voltage into sensing data SD which is a digital signal. Here, the sensing voltage to be applied to the ADC 131 may correspond to a level (VpreS+ΔV) increased by a predetermined voltage ΔV from the sensing reference voltage VpreS.

The data compensator 141 may identify a mobility of the driving transistor DT in the corresponding pixel PX based on the sensing data SD output from the ADC 131 and may compensate for a deviation in the characteristic value (here, the mobility) of the driving transistor DT.

That is, the mobility of the driving transistor DT may be proportional to a voltage variance per unit time (ΔV/Δt) of the reference voltage line RVL in the tracking step Tracking, in other words, a slope of a voltage waveform of the reference voltage line RVL. At this time, the compensation for the mobility deviation for the driving transistor DT may be referred to as a process of changing image data RGB, for example, an arithmetic process of multiplying image data RGB by a second compensation value, which is a mobility compensation data.

In addition, the sensing process of the driving transistor DT may be performed in real time while driving the image. Such a sensing process may be referred to as a real-time (RT) sensing process. During the RT sensing process, the sensing process may be performed on pixels PX disposed in at least one row in every blank period.

Accordingly, after finishing the sensing process for all pixels PX in the plurality of blank periods, the compensated data voltage Vdata may be output to the corresponding data lines DL through an output buffer.

Further, after performing the sensing process during the blank period, for every pixel PX in which the sensing process was performed, the second data voltage may be recovered to the third data voltage. If the data voltage Vdata is maintained at the second data voltage even after the sensing process, an image irrelevant to the image data RGB may be output. Therefore, the data voltage Vdata may be recovered to the third data voltage to prevent or reduce the potential degradation in the image quality occurring in the pixels in which the sensing process was completed.

Also, a process of sensing a mobility of a driving transistor DT and a process of sensing a threshold voltage of a driving transistor DT may be distinguished. Specifically, because the process of sensing a mobility of a driving transistor DT may take a shorter period of time than the process of sensing a threshold voltage, the process of sensing the mobility may be performed by the RT sensing process which is performed in a short period of time. In contrast, in the case of the process of sensing a threshold voltage of the driving transistor DT, the process may take a longer period of time to saturate a voltage at the second node N2 of the driving transistor DT so that the process may not be performed by the RT sensing processor.

Therefore, sensing data SD obtained from the RT sensing process may correspond to sensing data SD for the mobility value of the driving transistor DT. That is, the second compensation data may be consistently updated through the sensing data SD by the real-time sensing process, but the first compensation data may not be so updated.

Here, the compensation data may be changed due to an external factor, such as electrostatic discharge (ESD) or a physical impact. That is, the first compensation data for a threshold voltage may be changed to an error value due to an external factor so that the first compensation data may be maintained as the error value. In this case, even though the RT sensing process was performed as described above, the first compensation data would be maintained as an error value so that a potential problem of a bright spot or a dark spot being generated on the display panel may persist.

Accordingly, the inventors of the present application recognized a need for periodically updating the first compensation data as well.

Hereinafter, an operation of a memory and a data compensator of a display device according to an example embodiment of the present disclosure to periodically update the first compensation data will be specifically described.

Figure 5:
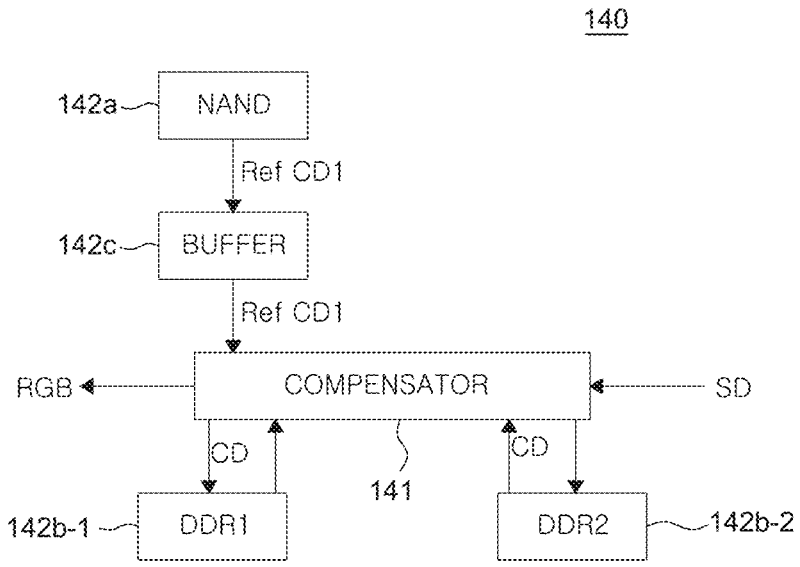
FIG. 5 is a block diagram of a timing controller of a display device according to an example embodiment of the present disclosure.

FIG. 5 is a block diagram of a timing controller 140 of a display device according to an example embodiment of the present disclosure.

As shown in FIG. 5, the timing controller 140 of the display device according to an example embodiment of the present disclosure may include a data compensator 141, a non-volatile memory (NAND) 142*a*, a plurality of volatile memories (DDR1 and DDR2) 142*b*-1 and 142*b*-2, and a buffer memory 142*c*.

The non-volatile memory (NAND) 142*a* (hereinafter, referred to as NAND) may be a long-term storage device capable of storing data even if the power to the display device is interrupted. For example, the NAND 142*a* may be a NAND flash memory.

Each of the plurality of volatile memories (DDR1 and DDR2) 142*b*-1 and 142*b*-2 may be a temporary storage device in which, when the power to the display device is interrupted, stored data may be lost. For example, each of the volatile memories may be a double data rate (DDR) DRAM.

The plurality of volatile memories (DDR1 and DDR2) 142*b*-1 and 142*b*-2 may include a first volatile memory (DDR1) 142*b*-1 (hereinafter, referred to as a DDR1) and a second volatile memory (DDR2) 142*b*-2 (hereinafter, referred to as DDR2) in which the compensation data CD may be written.

In a given frame, compensation data CD stored in any one of DDR1 142*b*-1 and DDR2 142*b*-2 may be used to compensate for the data voltage Vdata, and compensation data CD stored in the other one of DDR1 142*b*-1 and DDR2 142*b*-2 may be updated.

Specifically, during a vertical blank period (vertical blank time) of the given frame, the first compensation data and the second compensation data in the other one of DDR1 142*b*-1 and DDR2 142*b*-2 may be updated.

The buffer memory 142*c* may be a high speed temporary storage device for data transmission between the non-volatile memory (NAND) 142*a* and the plurality of volatile memories (DDR1 and DDR2) 142*b*-1 and 142*b*-2.

A reading timing of the NAND 142*a* and a writing timing of DDR1 142*b*-1 and DDR2 142*b*-2 may be controlled using the buffer memory 142*c*. A specific operation of the buffer memory 142*c* according to an example embodiment of the present disclosure will be described below with reference to FIGS. 6 and 7.

Figure 6:
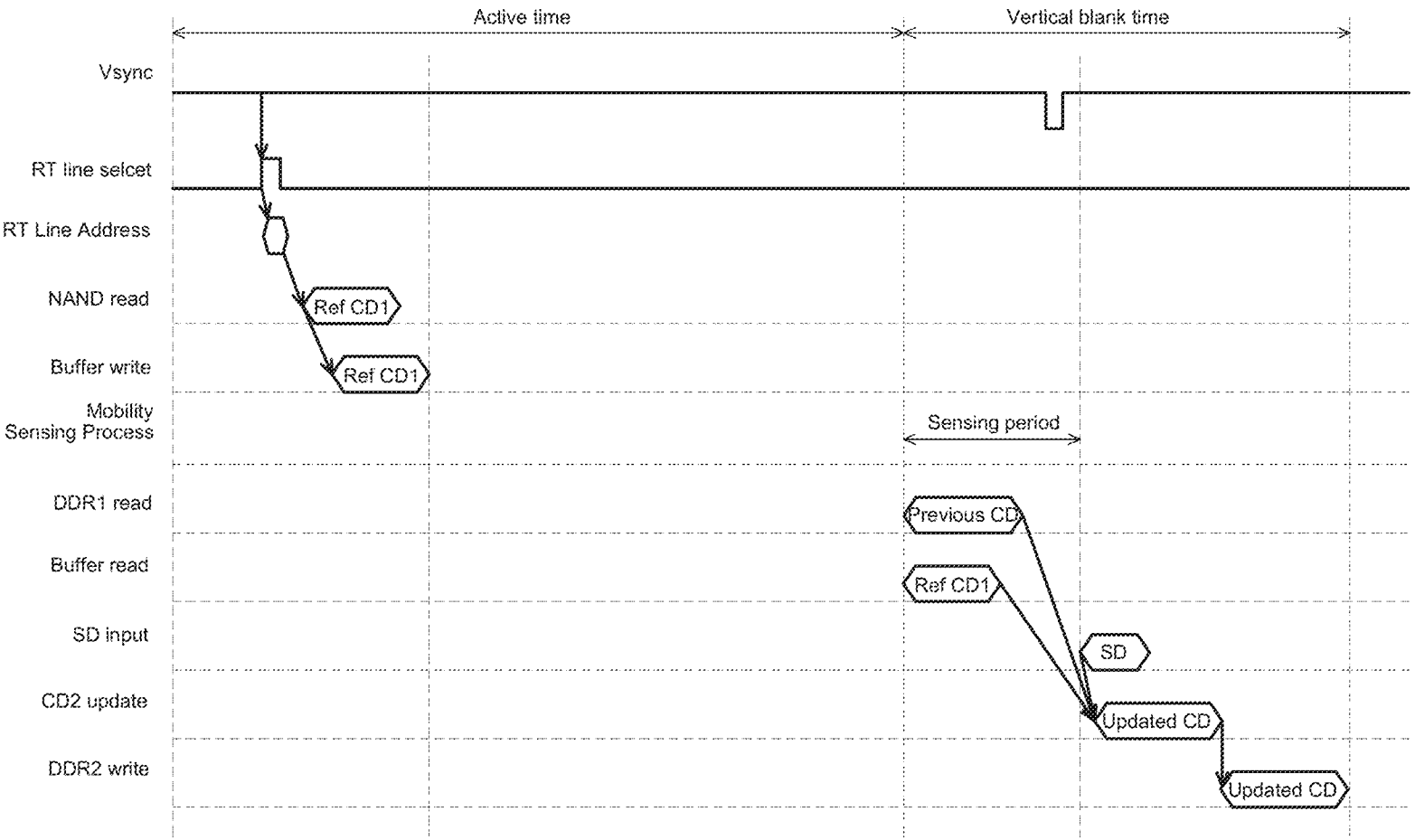
FIG. 6 is a timing chart for explaining an operation of a timing controller of a display device according to an example embodiment of the present disclosure.

FIG. 6 is a timing chart for explaining an operation of a timing controller of a display device according to an example embodiment of the present disclosure.

Figure 7:
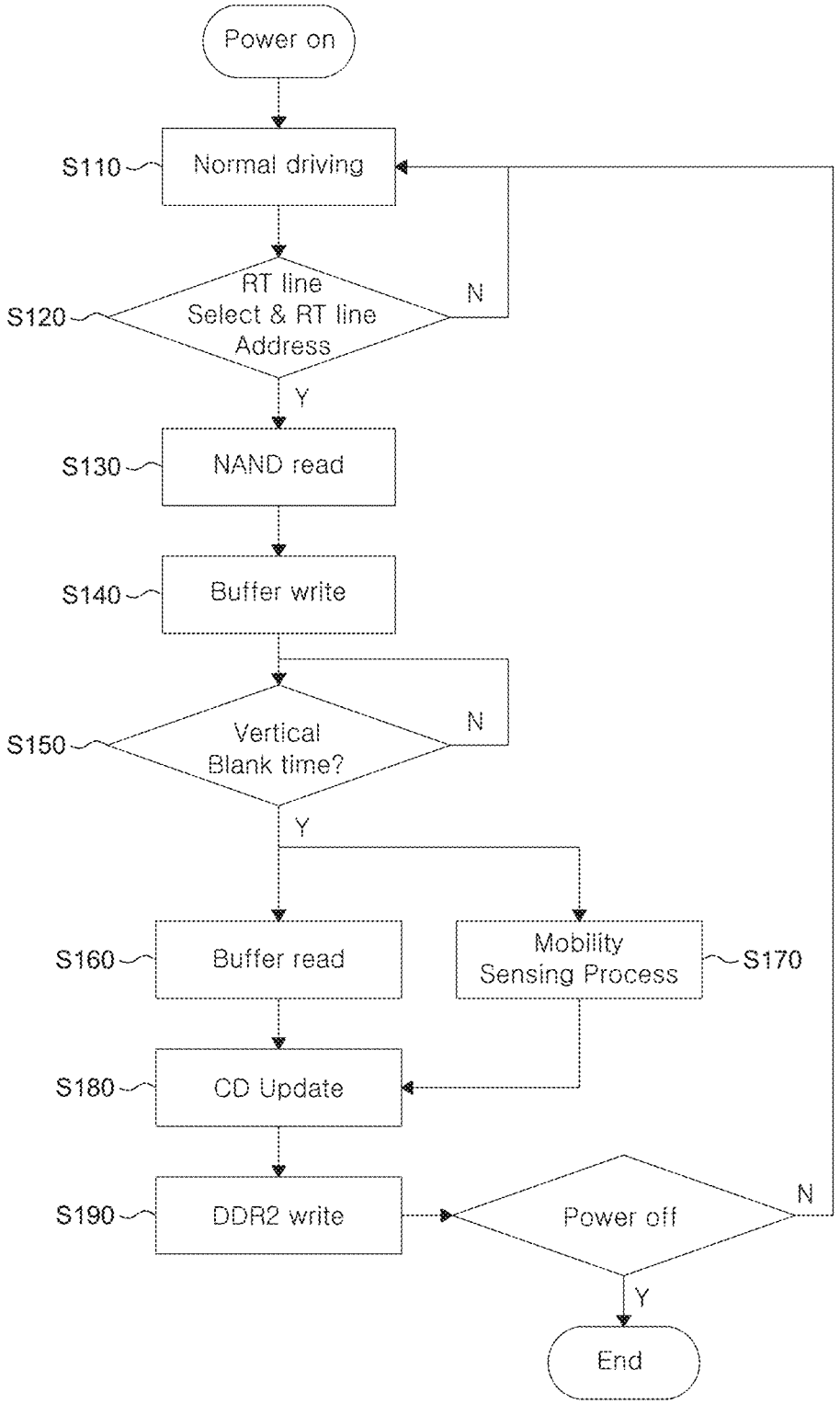
FIG. 7 is a flowchart for explaining an operation of a timing controller of a display device according to an example embodiment of the present disclosure.

FIG. 7 is a flowchart for explaining an operation of a timing controller of a display device according to an example embodiment of the present disclosure.

With reference to FIGS. 5 to 7, an RT sensing process according to an example embodiment of the present disclosure will be described for one frame defined by a horizontal synchronization signal Vsync after the display device is powered on.

As shown in FIGS. 6 and 7, when the display device is powered on and is normally driven (normal driving; S110), during the driving period (Active Time) in which an image is implemented, pixels disposed in one row in which the RT sensing process is to be performed may be selected, but the present disclosure is not limited thereto. For example, the RT sensing process may be performed not only on pixels disposed in one row but may be performed on pixels disposed in a plurality of rows.

Information about the pixels of one row on which the RT sensing process is to be performed is transmitted to the timing controller 140. Therefore, the timing controller 140 may designate an address of the sensing data SD which is transmitted according to the RT sensing process which will be performed later. The timing controller 140 described above may implement such communication protocol as low voltage differential signaling (LVDS), but it is not limited thereto and may implement any of various other communication protocols (RT line select & RT line address; S120).

If, during the driving period (Active time), pixels disposed in one row on which the RT sensing process is to be performed are not selected, the RT sensing process may not be performed, but the normal driving (S110) may be performed to implement the image.

After selecting the pixels disposed in one row on which the RT sensing process is to be performed, during the driving period (Active Time), reference first compensation data Ref CD1 stored in the NAND 142*a* may be read. To be more specific, during the driving period (Active Time), the buffer memory 142*c* may read the reference first compensation data Ref CD1 from the NAND 142*a* (NAND read; S130) and may write the reference first compensation data Ref CD1 in the buffer memory 142*c* (Buffer write; S140).

The above-described reference first compensation data Ref CD1 refers to compensation data for a threshold voltage of a driving transistor DT which is set in advance before shipment of the display device. As described above, in the case of the threshold voltage sensing process of the driving transistor DT, it may take a substantial amount of time to saturate a voltage of the second node N2 of the driving transistor DT so that the first compensation data may not be updated by means of the sensing data SD obtained from the RT sensing process. Accordingly, the first compensation data, which is compensation data for the threshold voltage of the driving transistor DT, may be updated in accordance with the reference first compensation data Ref CD1 stored in the NAND 142*a*.

Accordingly, in the display device according to the example embodiment of the present disclosure, if it enters the vertical blank period (vertical blank time) after the driving period (Active time) in S150, the data compensator 141 may read the reference first compensation data Ref CD1 from the buffer memory 142*c* (Buffer read; S160).

During the vertical blank period (vertical blank time), the data compensator 141 may read compensation data of a previous frame Previous CD stored in the DDR1 142*b*-1 (DDR read). The above-described compensation data of the previous frame Previous CD refers to compensation data which is updated in an earlier frame prior to the present frame. That is, the compensation data of the previous frame Previous CD may include the first compensation data and the second compensation data which are updated in the previous frame.

In the meantime, during the sensing period of the vertical blank time, the RT sensing process may be performed to calculate sensing data SD for the mobility of the driving transistor. That is, the data driver 130 may sample a sensing voltage from one electrode of the driving transistor to calculate the sensing data SD for the mobility of the driving transistor (Mobility Sensing Process; S170).

The data compensator 141 may update the compensation data of the previous frame Previous CD to compensation data of the present frame Updated CD using the sensing data SD and the reference first compensation data Ref CD1 (CD update; S180).

Specifically, the first compensation data of the previous frame may be compared with the reference first compensation data Ref CD1 to update to the first compensation data of the present frame. That is, if a difference between the first compensation data of the previous frame and the reference first compensation data Ref CD1 is determined to be a predetermined level or higher, the reference first compensation data Ref CD1 may be updated to the first compensation data CD1 of the present frame.

The second compensation data CD2 of the previous frame may be updated based on the sensing data SD to second compensation data CD2 of the present frame. That is, the data compensator 141 may apply the sensing data SD calculated from the RT sensing process to the second compensation data CD2 of the previous frame read from the DDR1 142*b*-1 to update to second compensation data CD2 of the present frame.

During the vertical blank period (vertical blank time), the data compensator 141 may write the updated compensation data Updated CD in the DDR2 142*b*-2. That is, the data compensator 141 may write both the updated first compensation data CD1 and second compensation data CD2 in the DDR2 142*b*-2 (DDR2 write; S190).

The data compensator 141 may compensate for the image data RGB using the compensation data Updated CD updated in the DDR2 142*b*-2 and may convert the compensated image data RGB into analog signal type data voltage Vdata to compensate for the data voltage Vdata, thereby performing a normal operation (Normal Driving; S110).

That is, in the present frame, the data voltage Vdata may be compensated for using the compensation data stored in the DDR2 142*b*-2 to perform the normal driving. In the meantime, in the present frame, the above-described RT sensing processing may be performed again using the compensation data CD stored in the DDR2 142*b*-2 to update the compensation data CD of the subsequent frame and store the updated compensation data in the DDR1 142*b*1.

In other words, in a given frame, compensation data CD stored in any one of DDR1 142*b*-1 and DDR2 142*b*-2 may be used to compensate for the data voltage Vdata, and compensation data CD stored in the other one of DDR1 142*b*-1 and DDR2 142*b*-2 may be updated.

During the driving period (Active time), the display device according to an example embodiment of the present disclosure may read the first reference compensation data Ref CD1 stored in the NAND 142*a* to store the first compensation data CD1 in any one of the plurality of volatile memories, e.g., 142*b*-1 and 142*b*-2, through the buffer memory 142*c*. An operation of the plurality of volatile memories, e.g., 142*b*-1 and 142*b*-2, according to an example embodiment of the present disclosure will be described in more detail with reference to FIG. 8.

The stored reference first compensation data Ref CD1 may be stored in the non-volatile memory so that it is not a variable value. Therefore, the first compensation data CD1, which is updated based on the reference first compensation data Ref CD1, may maintain a normal value so that the value of the threshold voltage of the driving transistor may be normally compensated despite the external factors.

Hereinafter, an example method of compensating for image data and updating compensation data in a plurality of frames using a plurality of volatile memories will be described with reference to FIG. 8.

Figure 8:
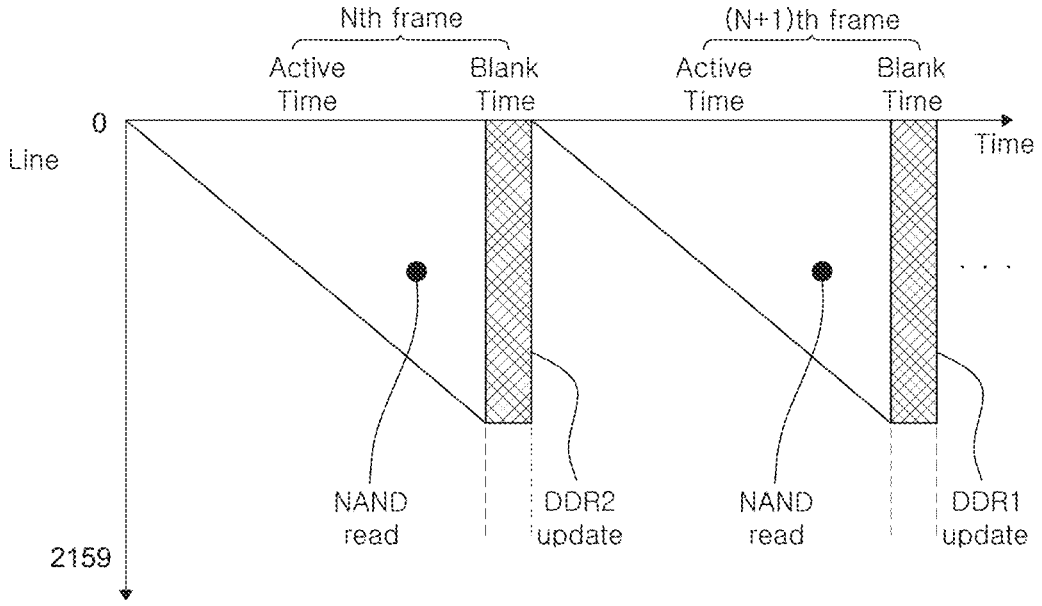
FIG. 8 is a graph for explaining an operation of a timing controller of a display device in each frame according to an example embodiment of the present disclosure.

FIG. 8 is a graph for explaining an operation for every frame of a timing controller of a display device according to an example embodiment of the present disclosure.

As illustrated in FIG. 8, during a driving period (Active Time) of an N-th frame, the reference first compensation data Ref CD1 may be read from the NAND 142*a* (NAND read). During the driving period (Active Time) of the N-th frame, the compensation data CD stored in the DDR1 142*b*-1 may be read to compensate for the image data RGB. During the blank period (blank time) of the N-th frame, the compensation data CD may be updated to be written in the DDR2 142*b*-2 (DDR2 update).

During a driving period (Active Time) of a following (N+1)-th frame, the reference first compensation data CD1 may be read from the NAND 142*a* (NAND read). Also during the driving period (Active Time) of the (N+1)-th frame, the compensation data CD stored in the DDR2 142*b*-2 may be read to compensate for the image data RGB. During the blank period (Blank Time) of the (N+1)-th frame, the compensation data CD may be updated to be written in the DDR1 142*b*-1 (DDR1 update).

As described above, the plurality of volatile memories 142*b*-1 and 142*b*-2 may be alternately used for every frame to perform the compensation of the image data and the updating of the compensation data in one frame. Therefore, in one frame, not only the image data may be compensated, but also the compensation data may be updated so that a separate time period for updating compensation data may not be necessary. Consequently, the display device according to example embodiments of the present disclosure may compensate for the image data without causing a separate time delay.

Hereinafter, an on-real time fast (On RF) mode sensing process will be described with reference to FIG. 9. This is a process of compensating for a mobility of the driving transistor at a time when the display device is powered on.

Figure 9:
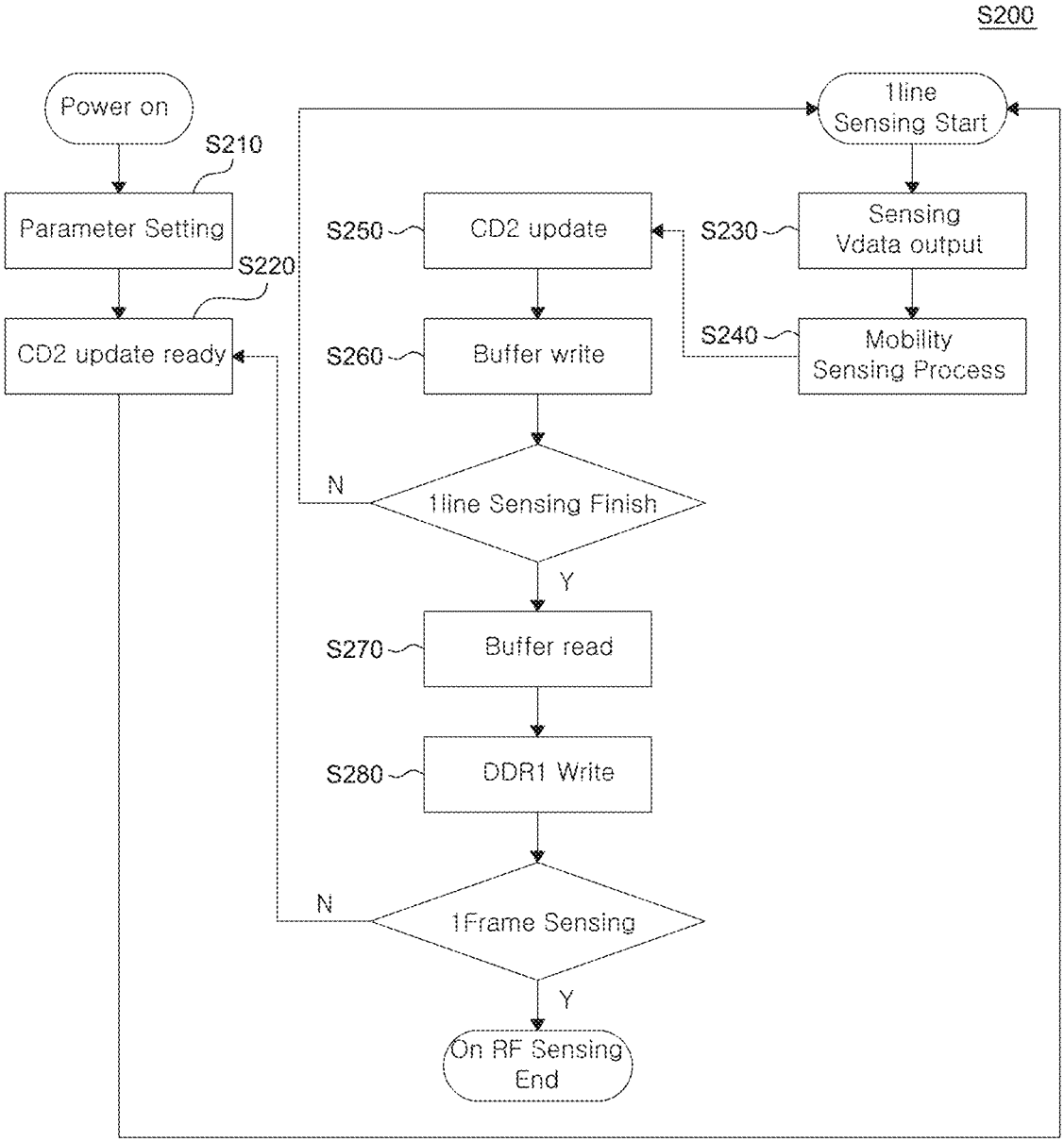
FIG. 9 is a flowchart for explaining an on real time fast mode (On RF) sensing process of a display device according to an example embodiment of the present disclosure.

FIG. 9 is a flowchart for explaining an On RF sensing process of a display device according to an example embodiment of the present disclosure.

As illustrated in FIG. 9, after the display device is powered on (Power on) and before the display panel implements an image, a parameter for On RF sensing process may be set (Parameter Setting; S210).

Specifically, the parameter setting means setting of timing information for mobility sensing and information related to a second data voltage, which is a sensing data voltage for mobility sensing.

To update the second compensation data, which is compensation data for a mobility of the driving transistor, sensing data and the second compensation data may be set as reference values (CD2 update ready; S220).

Next, sensing of a mobility of the driving transistor disposed in pixels of one row or line starts (1 line Sensing Start).

Specifically, with reference to FIGS. 2 and 4, the switching transistor SWT may be turned on by the scan signal SCAN at a turn-on level, and a second data voltage (i.e., a sensing data voltage for mobility sensing) may be output to the first node N1 of the driving transistor DT (Sensing Vdata output; S230).

With reference to FIGS. 2 and 4, the mobility of the driving transistor may be represented by sampling the rising of the sensing voltage on the reference voltage line RVL to calculate the sensing data SD (Mobility Sensing Process; S240).

With reference to FIG. 5, the calculated sensing data SD may represent a mobility value of the driving transistor so that the data compensator 141 may update the second compensation data CD2 corresponding to the deviation of the mobility of the driving transistor using the sensing data SD (CD2 update; S250).

Thereafter, the updated second compensation data CD2 may be written in the buffer memory 142*c* (Buffer write; S260).

After finishing the sensing of the mobility of the driving transistor disposed in the pixels in one row or line, the second compensation data CD2 written in the buffer memory 142*c* may be read (Buffer read; S270). The data compensator 141 may then write the updated second compensation data CD2 in the DDR1 142*b*-1 (DDR1 write; S280).

As described above, after completing the sensing of the mobility of the driving transistor disposed in the pixels in one row or line, if the sensing for all the pixels has not been performed, the mobility of the driving transistor disposed in pixels in another row or line may be sensed.

When the above-described sensing process has been performed for all the pixels, the On RF sensing process may end. Thereafter, a display device according to an example embodiment of the present disclosure may enter the RT sensing process.

Hereinafter, the RT sensing process will be described in more detail with reference to FIG. 10. For the convenience of description, FIGS. 4 to 6 may be further referenced.

Figure 10:
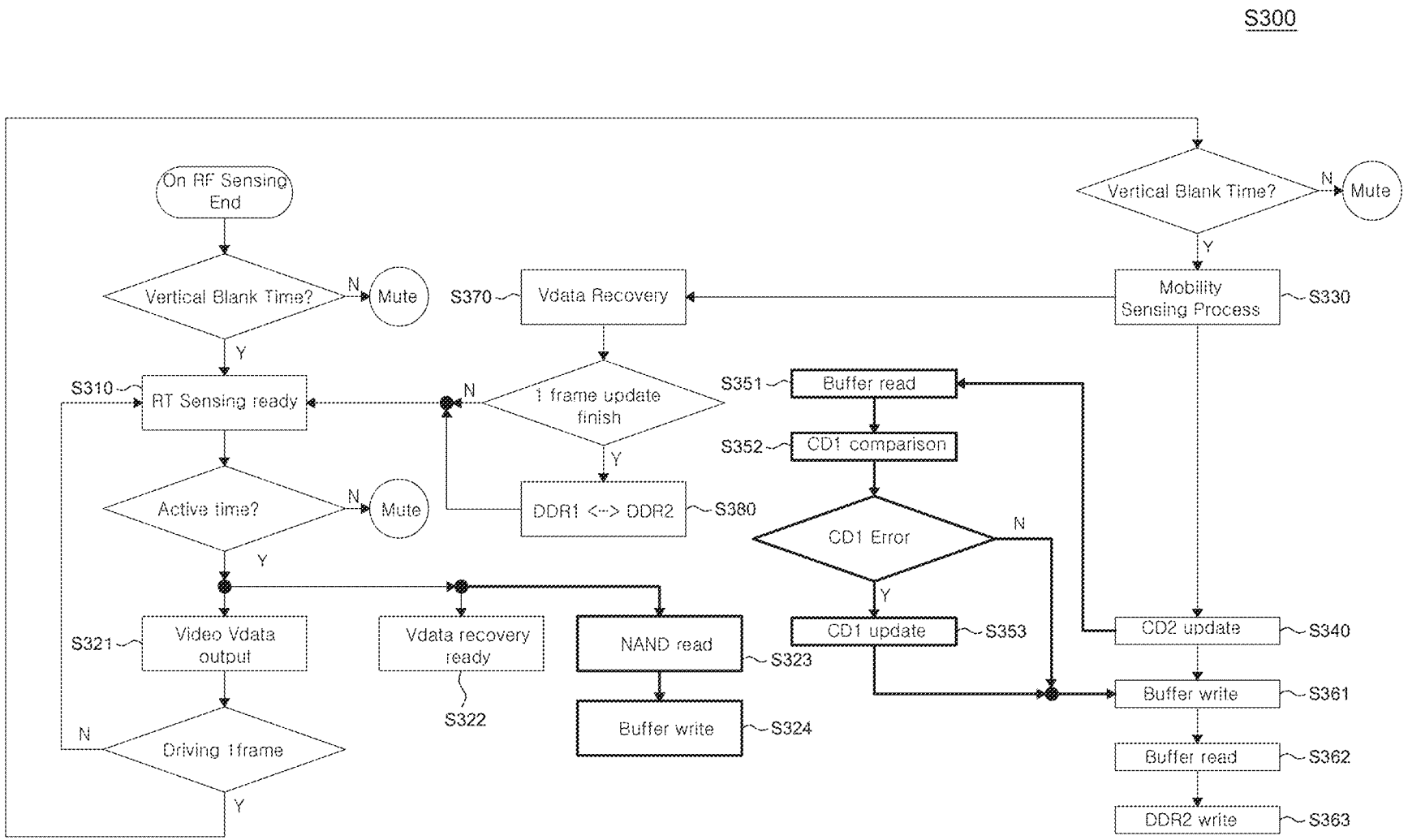
FIG. 10 is a flowchart for explaining a real time (RT) sensing process of a display device according to an example embodiment of the present disclosure.

FIG. 10 is a flowchart for explaining a RF sensing process of a display device according to an example embodiment of the present disclosure.

After finishing the On RF sensing process, if the display device enters the vertical blank period (vertical blank time), the RT sensing process may be prepared to begin (RT Sensing ready; S310).

However, if the display device does not enter the vertical blank period (vertical blank time), it may be in a mute state (Mute). The above-mentioned mute state may refer to a state in which no signal is output.

If the display device enters the driving period (Active time), the first data voltage (i.e., an image driving data voltage) may be output (Video Vdata output; S321), and a third data voltage (i.e., an image recovery data voltage) may be prepared (Vdata recovery ready; S322). The buffer memory 142*c* may read the reference first compensation data Ref CD1 from the NAND 142*a* (NAND read; S323) and may write the reference first compensation data Ref CD1 in the buffer memory 142*c* (Buffer write; S324).

Until the first data voltage is output to complete the driving of one frame, the image driving data voltage (i.e., the first data voltage) may be continuously output. When the driving of one frame is completed to enter a subsequent vertical blank period (Vertical Blank Time), the RT sensing process described above in FIG. 4 may be performed to calculate the sensing data SD for the mobility of the driving transistor. That is, the data driver 130 may calculate the sensing data SD for the mobility of the driving transistor by sampling a sensing voltage from one electrode of the driving transistor (Mobility Sensing Process; S330).

The second compensation data CD2 of the previous frame may be updated based on the sensing data SD to the second compensation data CD2 of the present frame. That is, the data compensator 141 may compare the sensing data SD calculated from the RT sensing process and the second compensation data CD2 of the previous frame read from the DDR1 142*b*-1 to update to new second compensation data CD2 (CD2 update; S340).

In the meantime, the data compensator 141 may read the reference first compensation data Ref CD1 from the buffer memory 142*c* (Buffer read; S351).

The first compensation data CD1 of the previous frame may be compared with the reference first compensation data Ref CD1 (CD1 comparison; S352). That is, if the difference between the first compensation data CD1 of the previous frame and the reference first compensation data Ref CD1 is at a predetermined error level or higher, the reference first compensation data Ref CD1 may be updated to the first compensation data CD1 of the present frame (CD1 update; S353).

Next, the updated first compensation data CD1 and the updated second compensation data CD2 may be written in the buffer memory 142*c* (Buffer write; S361). The first compensation data CD1 and the second compensation data CD2 written in the buffer memory 142*c* may be read to be written in the DDR2 142*b*-2. That is, the data compensator 141 may write the updated first compensation data CD1 and the updated second compensation data CD2 in the DDR2 142*b*-2 (DDR2 write; S363).

In the meantime, after ending the sensing processing in the blank period, the second data voltage may be recovered to the third data voltage (Vdata Recovery; S370).

If the compensation data for the pixels in all the pixel rows have not been updated, the RT sensing process may be prepared for pixels in the remaining pixel rows (RT sensing ready; S310). Then, the above-described processes may repeat for the pixels in the remaining pixel rows.

In contrast, if the compensation data CD has been updated for pixels of all the pixel rows, a new RT sensing process may be performed on the pixels of all the pixel rows using the compensation data written in the DDR2 142*b*-2.

That is, after performing a new RT sensing process using the compensation data CD written in the DDR2 142*b*-2, updated compensation data CD may be written in the DDR1 142*b*-1. This means that the plurality of volatile memories 142*b*-1 and 142*b*-2 may be alternately used for every frame (DDR1<->DDR2; S380).

The mobility value of the driving transistor may be normally corrected by the On RF sensing process by means of the series of above-described processes. Further, not only the mobility value of the driving transistor but also the threshold voltage value may be periodically compensated for by means of the subsequent RT sensing process.

Example embodiments of the present disclosure can also be described as follows:

A display device according to an example embodiment of the present disclosure may comprise: a display panel configured to be driven in an active time and a blank time within one frame, the display panel including a plurality of pixels each having a driving transistor; a data driver configured to provide a first data voltage based on an image data to the plurality of pixels in the active time; and a timing controller configured to compensate for the image data based on a first compensation data for a threshold voltage of the driving transistor and on a second compensation data for a mobility of the driving transistor, the timing controller including a data compensator, a non-volatile memory, and a plurality of volatile memories. The timing controller may be further configured to: read a reference first compensation data from the non-volatile memory in the active time, the reference first compensation data being a reference value for the first compensation data; and update the first compensation data and the second compensation data to be stored in one of the plurality of volatile memories in the blank time.

In some embodiments of the present disclosure, the timing controller may further include a buffer memory configured to read and store the reference first compensation data from the nonvolatile memory in the active time.

In some embodiments of the present disclosure, during the blank time, the data compensator may be configured to read the reference first compensation data from the buffer memory and to compare the reference first compensation data and the first compensation data to update the first compensation data.

In some embodiments of the present disclosure, during the blank time, the data driver may be configured to supply a second data voltage for sensing the mobility of the driving transistor to the plurality of pixels and to sample a sensing voltage from an electrode of the driving transistor to calculate a sensing data.

In some embodiments of the present disclosure, during the blank time, the data compensator may be configured to update the second compensation data based on the sensing data.

In some embodiments of the present disclosure, during the blank time, the data driver may be further configured to supply a third data voltage for image recovery to the plurality of pixels after calculating the sensing data.

In some embodiments of the present disclosure, before the display panel displays an image based on the image data, the data driver may be configured to supply a second data voltage for sensing the mobility of the driving transistor to the plurality of pixels and to sample a sensing voltage from an electrode of the driving transistor to calculate a sensing data.

In some embodiments of the present disclosure, before the display panel displays the image based on the image data, the data compensator may be configured to update the second compensation data based on the sensing data.

In some embodiments of the present disclosure, the plurality of volatile memories may include a first volatile memory and a second volatile memory. In a blank time of an N-th frame, the data compensator may be configured to update the first compensation data and the second compensation data to store in the second volatile memory, N being an integer. In a blank time of an (N+1)-th frame, the data compensator may be configured to update the first compensation data and the second compensation data to store in the first volatile memory.

In some embodiments of the present disclosure, in an active time of the N-th frame, the data compensator may be configured to read the first compensation data and the second compensation data from the first volatile memory to compensate for the image data. In an active time of the (N+1)-th frame, the data compensator may be configured to read the first compensation data and the second compensation data from the second volatile memory to compensate for the image data.

According to an example embodiment of the present disclosure, a method of driving a display device including a display panel, configured to be driven in an active time and a blank time within one frame and including a plurality of pixels each having a driving transistor, a non-volatile memory, a buffer memory, and a plurality of volatile memories, may comprise: reading a reference first compensation data from the non-volatile memory in the active time, the reference first compensation data being a reference value of a first compensation data for a threshold voltage of the driving transistor; writing the reference first compensation data in the buffer memory in the active time; reading the reference first compensation data from the buffer memory in the blank time following the active time; calculating a sensing data for a mobility of the driving transistor in the blank time; updating the first compensation data based on the reference first compensation data in the blank time and updating a second compensation data for the mobility of the driving transistor based on the sensing data in the blank time; and storing the updated first compensation data and the updated second compensation data in one of the plurality of volatile memories in the blank time.

In some embodiments of the present disclosure, the method may further comprise, in the active time, selecting pixels from which the sensing data is to be calculated among the plurality of pixels before the reading of the reference first compensation data.

In some embodiments of the present disclosure, the method may further comprise, in the active time, providing a first data voltage to the plurality of pixels, the first data voltage being an image driving data voltage determined based on the first compensation data and the second compensation data stored in another of the plurality of volatile memories.

In some embodiments of the present disclosure, the calculating of the sensing data in the blank time may include supplying a second data voltage for sensing a mobility of the driving transistor to the plurality of pixels.

In some embodiments of the present disclosure, the method may further comprise, after the calculating of the sensing data in the blank time, supplying a third data voltage to the plurality of pixels, the third data voltage being a data voltage for image recovery.

In some embodiments of the present disclosure, the method may further comprise, before the display panel displays an image based on an image data, supplying a second data voltage for sensing a mobility of the driving transistor to the plurality of pixels for calculating the sensing data and updating the second compensation data based on the sensing data.

A display device according to an example embodiment of the present disclosure may comprise: a display panel configured to be driven in an active time and a blank time within one frame, the display panel including a plurality of pixels each having a driving transistor; a data driver configured to provide a first data voltage based on an image data to the plurality of pixels in the active time for displaying an image, and provide a second data voltage for sensing a mobility of the driving transistor to the plurality of pixels in the blank time for determining a sensing data; a plurality of volatile memories to store a first compensation data for a threshold voltage of the driving transistor and a second compensation data for the mobility of the driving transistor; a non-volatile memory to store a reference first compensation data, the reference first compensation data being a reference value for the first compensation data; and a data compensator configured to update the first compensation data based on the reference first compensation data in the blank time, and update the second compensation data based on the sensing data in the blank time.

In some embodiments of the present disclosure, the display device may further comprise a buffer memory configured to read and store the reference first compensation data from the nonvolatile memory in the active time. During the blank time, the data compensator may be further configured to read the reference first compensation data from the buffer memory and to compare the reference first compensation data and the first compensation data to update the first compensation data.

In some embodiments of the present disclosure, during the blank time, the data driver may be further configured to sample a sensing voltage from an electrode of the driving transistor to calculate the sensing data, and supply a third data voltage for image recovery to the plurality of pixels after calculating the sensing data.

In some embodiments of the present disclosure, the plurality of volatile memories may include a first volatile memory and a second volatile memory. In a blank time of an N-th frame, the data compensator may be configured to update the first compensation data and the second compensation data to store in the second volatile memory, N being an integer. In a blank time of an (N+1)-th frame, the data compensator may be configured to update the first compensation data and the second compensation data to store in the first volatile memory.

Although example embodiments of the present disclosure have been described in detail with reference to the accompanying drawings, the present disclosure is not limited thereto and may be embodied in many different forms without departing from the technical concept of the present disclosure. Therefore, it should be understood that the above-described example embodiments are illustrative in all aspects and do not limit the present disclosure. The protective scope of the present disclosure should be construed based on the following claims, and all the technical concepts in the equivalent scope thereof should be construed as falling within the scope of the present disclosure.

It will be apparent to those skilled in the art that various modifications and variations can be made in the present disclosure without departing from the technical idea or scope of the disclosures. Thus, it is intended that embodiments of the present disclosure cover the modifications and variations of the disclosure provided they come within the scope of the appended claims and their equivalents.

What is claimed is:

1. A display device, comprising:

a display panel configured to be driven in an active time and a blank time within one frame, the display panel including a plurality of pixels each having a driving transistor;

a data driver configured to provide a first data voltage based on an image data to the plurality of pixels in the active time; and a timing controller configured to compensate for the image data based on a first compensation data for a threshold voltage of the driving transistor and on a second compensation data for a mobility of the driving transistor, the timing controller including a data compensator, a non-volatile memory, and a plurality of volatile memories, wherein the timing controller is further configured to:

read a reference first compensation data from the non-volatile memory in the active time, the reference first compensation data being a reference value for the first compensation data; and update the first compensation data and the second compensation data to be stored in one of the plurality of volatile memories in the blank time.

2. The display device of claim 1, wherein the timing controller further includes a buffer memory configured to read and store the reference first compensation data from the nonvolatile memory in the active time.

3. The display device of claim 2, wherein, during the blank time, the data compensator is configured to read the reference first compensation data from the buffer memory and to compare the reference first compensation data and the first compensation data to update the first compensation data.

4. The display device of claim 1, wherein, during the blank time, the data driver is configured to supply a second data voltage for sensing the mobility of the driving transistor to the plurality of pixels and to sample a sensing voltage from an electrode of the driving transistor to calculate a sensing data.

5. The display device of claim 4, wherein, during the blank time, the data compensator is configured to update the second compensation data based on the sensing data.

6. The display device of claim 4, wherein, during the blank time, the data driver is further configured to supply a third data voltage for image recovery to the plurality of pixels after calculating the sensing data.

7. The display device of claim 1, wherein, before the display panel displays an image based on the image data, the data driver is configured to supply a second data voltage for sensing the mobility of the driving transistor to the plurality of pixels and to sample a sensing voltage from an electrode of the driving transistor to calculate a sensing data.

8. The display device of claim 7, wherein, before the display panel displays the image based on the image data, the data compensator is configured to update the second compensation data based on the sensing data.

9. The display device of claim 1, wherein:

the plurality of volatile memories includes a first volatile memory and a second volatile memory, in a blank time of an N-th frame, the data compensator is configured to update the first compensation data and the second compensation data to store in the second volatile memory, N being an integer, and in a blank time of an (N+1)-th frame, the data compensator is configured to update the first compensation data and the second compensation data to store in the first volatile memory.

10. The display device of claim 9, wherein:

in an active time of the N-th frame, the data compensator is configured to read the first compensation data and the second compensation data from the first volatile memory to compensate for the image data, and in an active time of the (N+1)-th frame, the data compensator is configured to read the first compensation data and the second compensation data from the second volatile memory to compensate for the image data.

11. A method of driving a display device including a display panel, configured to be driven in an active time and a blank time within one frame and including a plurality of pixels each having a driving transistor, a non-volatile memory, a buffer memory, and a plurality of volatile memories, the method comprising:

reading a reference first compensation data from the non-volatile memory in the active time, the reference first compensation data being a reference value of a first compensation data for a threshold voltage of the driving transistor;

writing the reference first compensation data in the buffer memory in the active time;

reading the reference first compensation data from the buffer memory in the blank time following the active time;

calculating a sensing data for a mobility of the driving transistor in the blank time;

updating the first compensation data based on the reference first compensation data in the blank time and updating a second compensation data for the mobility of the driving transistor based on the sensing data in the blank time; and storing the updated first compensation data and the updated second compensation data in one of the plurality of volatile memories in the blank time.

12. The method of claim 11, further comprising:

in the active time, selecting pixels from which the sensing data is to be calculated among the plurality of pixels before the reading of the reference first compensation data.

13. The method of claim 11, further comprising:

in the active time, providing a first data voltage to the plurality of pixels, the first data voltage being an image driving data voltage determined based on the first compensation data and the second compensation data stored in another of the plurality of volatile memories.

14. The method of claim 11, wherein the calculating of the sensing data in the blank time includes supplying a second data voltage for sensing a mobility of the driving transistor to the plurality of pixels.

15. The method of claim 14, further comprising:

after the calculating of the sensing data in the blank time, supplying a third data voltage to the plurality of pixels, the third data voltage being a data voltage for image recovery.

16. The method of claim 11, further comprising:

before the display panel displays an image based on an image data, supplying a second data voltage for sensing a mobility of the driving transistor to the plurality of pixels for calculating the sensing data and updating the second compensation data based on the sensing data.

17. The display device, comprising:

a display panel configured to be driven in an active time and a blank time within one frame, the display panel including a plurality of pixels each having a driving transistor;

a data driver configured to:

provide a first data voltage based on an image data to the plurality of pixels in the active time for displaying an image; and provide a second data voltage for sensing a mobility of the driving transistor to the plurality of pixels in the blank time for determining a sensing data;

a plurality of volatile memories to store a first compensation data for a threshold voltage of the driving transistor and a second compensation data for the mobility of the driving transistor;

a non-volatile memory to store a reference first compensation data, the reference first compensation data being a reference value for the first compensation data; and a data compensator configured to:

update the first compensation data based on the reference first compensation data in the blank time; and update the second compensation data based on the sensing data in the blank time.

18. The display device of claim 17, further comprising:

a buffer memory configured to read and store the reference first compensation data from the nonvolatile memory in the active time, wherein, during the blank time, the data compensator is further configured to read the reference first compensation data from the buffer memory and to compare the reference first compensation data and the first compensation data to update the first compensation data.

19. The display device of claim 17, wherein, during the blank time, the data driver is further configured to:

sample a sensing voltage from an electrode of the driving transistor to calculate the sensing data; and supply a third data voltage for image recovery to the plurality of pixels after calculating the sensing data.

20. The display device of claim 17, wherein:

the plurality of volatile memories includes a first volatile memory and a second volatile memory, in a blank time of an N-th frame, the data compensator is configured to update the first compensation data and the second compensation data to store in the second volatile memory, N being an integer, and in a blank time of an (N+1)-th frame, the data compensator is configured to update the first compensation data and the second compensation data to store in the first volatile memory.

* * * * *